United States Patent [19]

Stenz

[11] 4,400,051

[45] Aug. 23, 1983

[54] ELECTRICAL PLUG AND SOCKET CONNECTORS

[75] Inventor: Paul P. Stenz, Detmold, Fed. Rep. of Germany

[73] Assignee: C. A. Weidmuller GmbH, Detmold, Fed. Rep. of Germany

[21] Appl. No.: 255,090

[22] Filed: Apr. 17, 1981

[30] Foreign Application Priority Data

Apr. 17, 1980 [DE] Fed. Rep. of Germany ..... 3014706

[51] Int. Cl.[3] ..... H01R 4/24

[52] U.S. Cl. ..... 339/217 S; 339/262 R

[58] Field of Search ..... 339/176 R, 176 M, 198 G, 339/198 GA, 198 H, 198 P, 198 S, 217 S, 262

[56] References Cited

U.S. PATENT DOCUMENTS

| | | | |
|---|---|---|---|
| 2,392,438 | 1/1946 | Wade | 339/262 R |
| 2,813,257 | 11/1957 | Cornell | 339/262 R |
| 3,112,977 | 12/1963 | Long et al. | 339/262 R |
| 3,172,721 | 3/1965 | Kelly | 339/176 M |
| 3,187,297 | 6/1965 | Gluntz | 339/176 |
| 3,259,870 | 7/1966 | Winkler | 339/255 R |
| 3,654,595 | 4/1972 | Curr | 339/262 R |
| 3,721,943 | 3/1973 | Curr | 339/217 S |
| 3,781,770 | 12/1973 | Mancini | 339/262 R |

FOREIGN PATENT DOCUMENTS 781606 8/1957 United Kingdom .

*Primary Examiner*—John McQuade
*Assistant Examiner*—Paula Austin
*Attorney, Agent, or Firm*—Pollock, Vande Sande & Priddy

[57] ABSTRACT

An electrical plug and socket connector has in the socket part a contact consisting of a contact pin identical to that of the plug part, combined with a cage which fits loosely in the socket housing, embraces the contact pin and incorporates a contact spring, thus isolating contact pressures within the contact assembly so that the housing is not stressed. The contact pin is retained by a snap-in retainer. The plug part has an identical pin and retaining means.

13 Claims, 8 Drawing Figures

Figure 5:
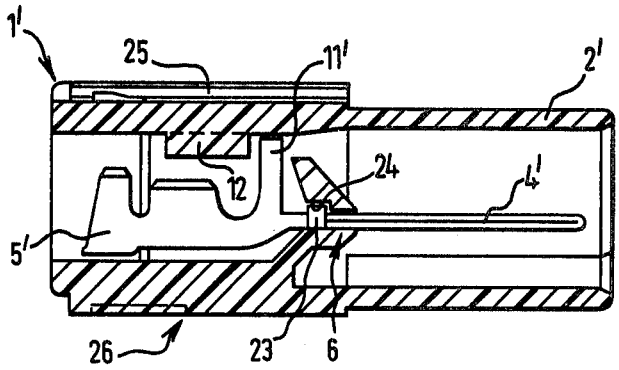

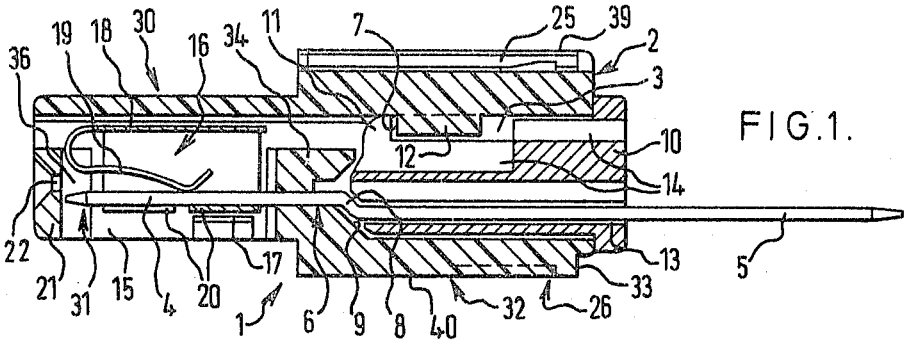
FIG.1.
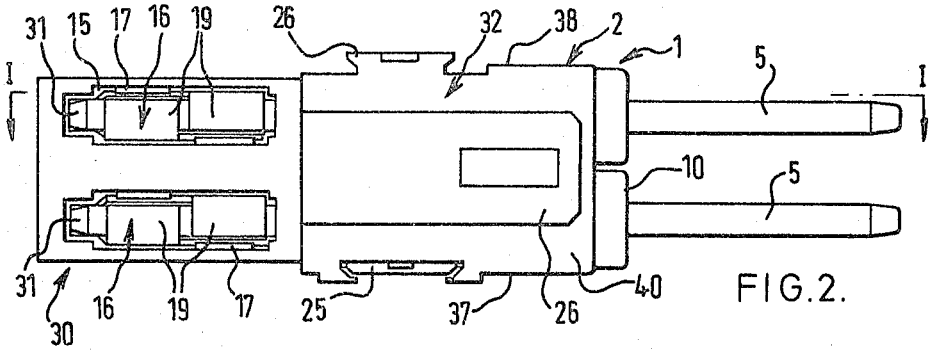
FIG.2.
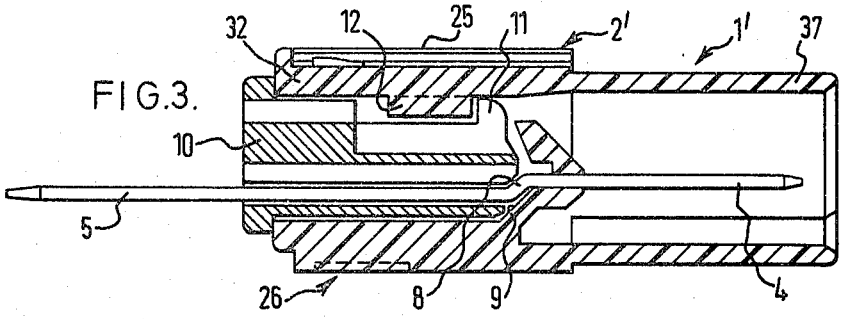
FIG.3.
FIG.4.
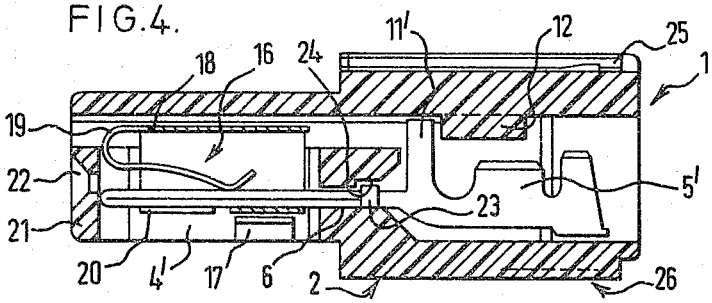

ELECTRICAL PLUG AND SOCKET CONNECTORS

This invention relates to electrical plug and socket connectors.

In most plug and socket connectors, the plug pins and socket contacts are quite different from one another. The need to make, stock and assemble different components increases cost.

British Patent Specification No. 781,606 discloses a cable connector in which the two connector elements are identical, as are their respective contacts. However, the construction disclosed is complex and difficult to assemble. Another disadvantage is that the contact pressure is applied by leaf springs which react against the insulating casing of the connector. The casing is therefore subjected to constant pressure which can lead to softening and deformation. The assembly of a multipole connector would be difficult because of the complex construction.

The object of the present invention is to provide a plug and socket connector using a very small number of simple parts, while assuring that contact pressure is reliably maintained.

The present invention resides in an electrical plug and socket connector comprising a plug member and a mating socket member, in which the plug member comprises an insulating plug housing, at least one plug pin contact therein, and contact-retaining means in the housing and in snap-action engagement therewith for holding the plug pin contact in the plug housing. The socket member comprises an insulating socket housing, at least one socket contact therein, and contact-retaining means in the socket housing and in snap-action engagement therewith for holding the socket contact in the socket housing. The said socket contact comprises a contact pin identical to the said plug pin, and a cage member which embraces the said socket contact pin carries an internal resilient element adjoining said socket contact pin for exerting contact pressure on a said plug pin when inserted into said socket contact, and is disposed loosely with respect to the socket housing.

The pins are preferably standard plug pins. The fact that a standard contact pin is used not only in the plug but also in the socket provides an exceptionally simple construction.

The snap-in contact-retaining means can be integral with the associated contact, or can be a separate retaining member. In either case, suitable retaining means can be produced very simply. The use of snap-in retaining means, in conjunction with the relatively small number of different component parts required, greatly facilitates assembly. In the preferred embodiments of the invention, assembly simply consists of inserting the contacts, a very simple operation, accompanied by or followed by snap engagement of the contact-retaining means in the housing.

The cage member provided with the contact spring absorbs all the reaction forces arising from contact pressure in the socket. Because it is loose in the housing, contact forces are not transmitted to the housing, which is therefore not subject to deterioration caused by such forces. Because the cage member is loose relative to the housing, assembly is, again, very simple. It will be understood that, in use, the respective pins of the inter-engaged plug and socket contacts are pressed between the contact spring and a wall of the cage member. The cage member does not have to carry any current and can therefore be made of the material most suitable for applying and sustaining contact pressure. It will in general be made of metal.

The extremely simple construction of the connector, particularly in the contact region, and the simple assembly procedure, are particularly advantageous in the case of connectors with a very large number of poles, particularly if they are assembled by the user rather than the manufacturer. The ease and flexibility with which the plug and socket members can be fitted with contacts depending on the requirements of a particular installation is especially advantageous in the case of multi-pole connectors which are assembled from individual plug and socket units to give a desired number and arrangement of poles.

For maximum ease and flexibility, the plug and socket members should all have identical arrangements for retaining the contacts and, if a variety of contact types is available, these should all be adapted to cooperate with the contact-retaining elements of the housings, so that the user can combine any of the available contact types with any plug or socket housing.

Preferably, each housing contains a wedge-shaped retainer, which is engaged by a pair of resilient projections on an inserted contact or on a separate contact-retaining member.

Figure 6:
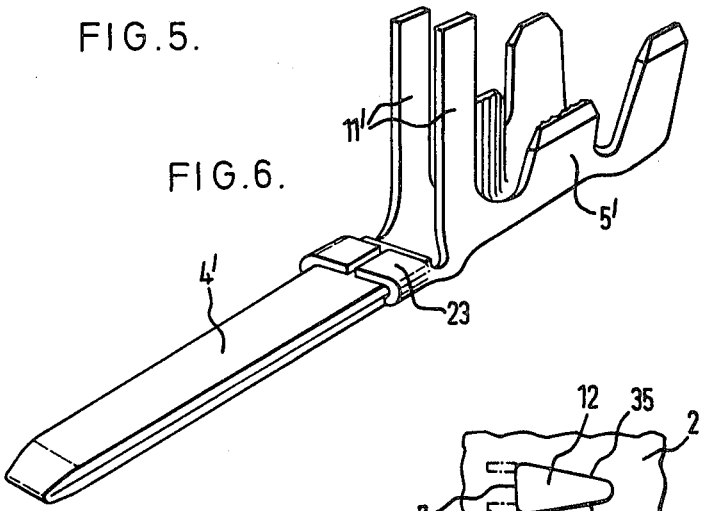
Figure 7:
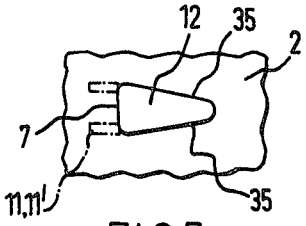
Figure 8:
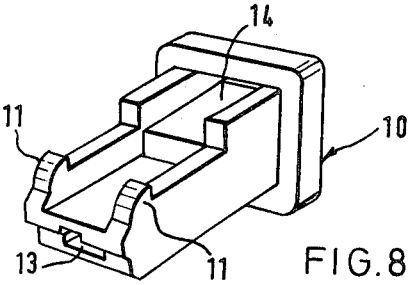

Embodiments of the invention are shown by way of example in the accompanying drawings, in which:

FIG. 1 is a longitudinal section through a socket unit on the line I—I in FIG. 2, FIG. 2 is a bottom view of the socket unit, FIG. 3 is a longitudinal section of a plug unit corresponding to the socket unit of FIGS. 1 and 2, FIG. 4 is a longitudinal section of a socket unit containing a different contact from that shown in FIG. 1, FIG. 5 is a longitudinal section of a plug unit corresponding to the socket unit of FIG. 4, FIG. 6 is an enlarged perspective view of the contact pin and crimp terminal shown in FIGS. 4 and 5, FIG. 7 shows detent means in the plug and socket housings, and FIG. 8 is a perspective view of a contact-retaining member shown in FIGS. 1 and 3.

FIGS. 1 and 2 show a two-pole socket member 1 of a plug and socket connector. The socket member has an insulating plastic housing 2 with a front region 30 containing a socket contact 31, and a rear region 32 in which is a chamber 3 open at the side 33 of the housing remote from the socket contact. Between the chamber 3 and the front region of the housing is a wall 34 in which is a guide aperture 6 which locates a contact pin 4 of standard dimensions. The illustrated pin is of the kind disclosed for a wire-wrap terminal 5 in German Industrial Standard DIN 41611. The contact pin 4 is inserted through the chamber 3 and the guide aperture 6 into the front region 30 of the insulating housing. It has an intermediate offset portion 8 which rests against a corresponding oblique surface 9 at the forward end of the chamber 3. The contact pin is held in the insulating housing 2 by a separate retaining member 10 which is inserted into the chamber 3 from the rear. The retaining member 10 has at its forward end a pair of laterally extending spaced resilient detent tongues 11. In the chamber 3 the insulating housing has a wedge-shaped detent projection 12, shown in FIG. 7. This projection is triangular or wedge-shaped, with oblique side surfaces 35, tapering towards the open side of the chamber, and a transverse abutment surface 7 at the end of the wedge furthest from the open side of the chamber. When the retaining member 10 is pushed into the chamber 3, the tongues 11 slide along and are forced apart by the oblique side surfaces 35 of the projection 12, and then, when the member 10 is fully inserted, the tongues 11 snap into place as shown in FIG. 7, in engagement with the abutment surface 7 of the projection 12. The member 10 is thus positively retained in the chamber 3. It has an aperture 13 which accommodates the front region of the rearwardly extending wire-wrap terminal 5, and positively holds the contact pin 4 in place in the insulating housing.

In the upper region, the retaining member 10 has an offset opening 14 through which a rod-like special tool can be inserted to spread apart the tongues 11 in order to release the member 10 and hence the contact pin so that the latter can be removed.

The rear part of the wire-wrap terminal 5 projects from the rear of the insulating housing so that a conductor wire can be wrapped round it.

In addition to the contact pin 4, the socket contact includes a cage member 16 of sheet metal bent to form a tube of substantially rectangular cross-section with an upper wall 18 and a bottom wall 20. Integral with one end of the upper wall 18 is a resilient tongue 19 which is curved back inside the cage so that its free end is adjacent to the bottom wall 20. The contact pin 4 extends between the resilient tongue 19 and the bottom wall 20 of the cage and is accordingly pressed by the tongue against the bottom wall.

Between the tongue 19 and the tip of the contact pin is a gap 36 which faces an entry aperture 22 in the front end of the insulating housing 2, to receive a plug pin of an associated plug member. The aperture 22 is formed in an end wall 21 of the contact region 30 of the insulating housing, which forms a guide member for the plug pin. The inserted plug pin slides over the contact pin 4 of the socket and under the resilient tongue 19, so that the two pins are pressed against one another and against the bottom wall 20 of the cage member 16, by the resilient tongue 19. It will be seen that all of the contact forces are absorbed within the socket contact, in particular by the cage 16, and because the cage 16 is mounted loosely in the insulating housing, no contact forces are transmitted to the housing.

The cage member 16 is inserted into the insulating housing through an aperture 15 in the underside of the forward contact region 30 of the housing. At the sides of the aperture 15 there are detent projections 17 past which the cage member is pushed and which then hold the cage member in the housing. After insertion of the cage member, the contact pin 4 and the retaining member 10 are inserted into the housing from the rear so that the pin passes through the cage member.

FIG. 3 shows a plug member 1' corresponding to the socket member of FIGS. 1 and 2. It has an insulating housing 2' with a rear region 32 identical to that of the socket member, and its contact consists of a plug pin 4 identical to that in the socket member. The plug member differs from the socket member only in that it does not incorporate a cage member 16, and the forward region 37 of the insulating housing forms a shroud enclosing the plug pin 4 and designed to receive the forward region 30 of the socket member. In all other respects the plug member is identical to the socket member. Assembly of the plug member simply involves insertion into the insulating housing, from its rear, of the plug pin 4 and the retaining member 10 which is held in place by the previously described snap action. The entire plug and socket connector consisting of plug and socket members requires only five different component parts, namely, two housings, standard contact pins, cage members and contact-retaining members, and these components are very quickly and easily assembled. The small number of individual types of component used, and their ease of assembly, facilitate and reduce the cost of manufacture.

For greater flexibility, alternative contacts can be provided, for example as illustrated in FIGS. 4 to 6. FIGS. 4 and 5 respectively show socket and plug members. These have insulating housings substantially identical to those of the socket and plug members shown in FIGS. 1 to 3, the constituents of which are identified by the same reference numbers as are used in FIGS. 1 to 3 and are not described again. The only difference from the embodiments shown in FIGS. 1 to 3 is that the standard contact pin and contact-retaining member 10, in both the plug and socket members, are replaced by standard flat contact pins 4' integral with contact-retaining means. In FIGS. 4 and 5, the contact pins 4' are directly attached, by crimped lugs 23, to crimp terminals 5' for example in accordance with German Industrial Standard DIN No. 46244. The contact pin and terminal unit is shown in detail in FIG. 6. The crimp terminal has a pair of integral tongues 11' which make snap-action engagement with the detent projection 12 in a manner analogous to the tongues 11 of the contact-retaining members 10 previously described. The construction of the crimp terminal allows space below the projection 12 for insertion of a tool to spread the tongues 11' apart so that the contact can be released from the projection 12 and withdrawn from the insulating housing. The internal wall 34 in the housing has a recess 24 to accommodate the crimp lugs 23, at the rear of the guide aperture 6. As in FIG. 1, the socket contact incorporates a cage member 16 which embraces the pin 4'.

Thus, using identical insulating housings, connectors can be assembled with either wire-wrap terminals or crimp terminals, or a mixture of such terminals can be used.

The flexibility and ease of installation of the plug and socket connector described are enhanced if the insulating housings are designed to be assembled side by side with one another to form multiple-pole connector blocks. To this end, the identical rear regions 32 of all the insulating housings are of rectangular, preferably square, cross-section, having on a first pair of opposite surfaces 37, 38 dovetail grooves 25 and tongues 26 respectively, oriented at right angles to the longitudinal direction of the housing and the inserted contacts. The other pair of external surfaces 39, 40 has dovetail groove 25 and tongue 26, respectively, extending parallel to the said longitudinal direction. By means of the dovetail tongues and grooves, individual housings can be coupled together by a simple plugging action to form connector blocks having any desired size and shape. The use of tongues and grooves extending in two perpendicular directions provides a very secure assembly, assuring that an individual housing cannot be removed from the assembled connector block. In consequence, even if very substantial retaining forces have to be overcome when a plug block and a socket block are separated from one another, these forces will not cause individual plug or socket members to become detached from their blocks. Because the coupling regions of the insulating housings are all identical, a connector block can contain a mixture of plug members and socket members.

I claim:

1. An electrical plug and socket connector comprising a plug member and a mating socket member, and in which: the plug member comprises an insulating plug housing, at least one plug contact pin therein, and contact-retaining means in the housing and in snap-action engagement therewith for holding the plug pin contact in the plug housing; the socket member comprises an insulating socket housing, at least one socket contact therein, and contact-retaining means in the socket housing and in snap-action engagement therewith for holding the socket contact in the socket housing; and the said socket contact comprises a contact pin identical to the said plug contact pin, and a cage member which embraces said socket contact pin, carries an internal resilient element adjoining said socket contact pin for exerting contact pressure on a said plug contact pin when inserted into said socket contact, and is disposed loosely with respect to the socket housing.

2. A connector according to claim 1, wherein each said housing has an internal chamber open at the side of said housing remote from the associated contact for insertion of said contact, said chamber contains a wedge-shaped detent element which tapers towards the open chamber side and has at the end of the wedge remote from said open side, a transverse abutment surface, said contact-retaining means comprising two spaced relatively resiliently displaceable detent projections adapted to slide over said wedge-shaped detent element into snap engagement with said abutment surface.

3. A connector according to claim 2, wherein each contact pin is provided with a wire-warp terminal projecting through said open housing side, and the retaining means comprise a separate retaining member adapted to be inserted into said chamber through said open side and on which said detent projections are provided.

4. A connector according to claim 3, wherein an offset portion is provided between said contact pin and said wire-wrap terminal, and each said housing has an internal sloping surface on which the offset portion bears.

5. A connector according to claim 3, wherein said retaining member has a stepped opening, extending to the detent projections, for insertion of a tool to release the said projections from the abutment surface.

6. A connector according to claim 3, including an aperture in the retaining member for receiving the leading region of the wire-wrap terminal.

7. A connector according to claim 2, wherein said contact pin is provided with a crimp terminal and said detent projections are integrally formed on said crimp terminal.

8. A connector according to claim 7, comprising crimping lugs which crimp said contact pins to said crimp terminal, and a receptacle in said housing for said crimping lugs.

9. A connector according to claim 1, having in each housing a guide aperture for the contact pin.

10. A connector according to claim 1 or 7, wherein in all said plug and socket members have identical contact-retaining means.

11. A connector according to claim 1, wherein which each housing has external means for coupling together a plurality of the housings to form a multipole connector block.

12. A connector according to claim 11, wherein each each housing has four external lateral surfaces forming two pairs of opposite surfaces, each pair having on one surface thereof a coupling groove and on the opposite surface a corresponding coupling tongue, the tongue and groove of one surface pair extending in the direction of connector mating movement of said housing, and the tongue and groove of the other surface pair extending transversely to the said direction.

13. A plug and socket connector with a socket member and a plug member each provided with a respective casing and identically constructed contact which are positively retained in the socket member and in the plug member and are thrust against each other by spring force when said plug member is inserted into said socket member, the contacts for said plug member as well as the contacts for said socket member being formed of standard contact pins, associated with retaining elements for snap-on locking on retaining elements in the socket and plug member casings, a cage member being loosely inserted in the socket casing for each pole, and one wall of said cage member being provided with a resilient tongue which thrusts the two standard contact pins of said socket member and plug member respectively against each other and against a further wall of said cage member when said plug member is inserted into said socket member.

* * * * *